US007853031B2

(12) United States Patent
Hamacher

(10) Patent No.: US 7,853,031 B2
(45) Date of Patent: Dec. 14, 2010

(54) HEARING APPARATUS AND A METHOD FOR OWN-VOICE DETECTION

(75) Inventor: Volkmar Hamacher, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1190 days.

(21) Appl. No.: 11/484,915

(22) Filed: Jul. 11, 2006

(65) Prior Publication Data

US 2007/0009122 A1 Jan. 11, 2007

(30) Foreign Application Priority Data

Jul. 11, 2005 (DE) ..... 10 2005 032 274

(51) Int. Cl.
*H04R 25/00* (2006.01)

(52) U.S. Cl. ..... 381/317; 381/312

(58) Field of Classification Search ..... 381/23.1, 381/71.6, 72, 73, 312, 314, 315, 317, 318, 381/320, 321, 322, 330, 331; 704/233; 600/23, 600/24, 25, 559

See application file for complete search history.

(56) References Cited

U.S. PATENT DOCUMENTS

| | | | | |
|---|---|---|---|---|
| 4,633,498 | A | 12/1986 | Warnke et al. | |
| 6,041,129 | A | 3/2000 | Adelman | |
| 6,526,148 | B1 | 2/2003 | Jourjine et al. | |
| 6,728,385 | B2 * | 4/2004 | Kvaløy et al. | 381/317 |
| 6,937,738 | B2 | 8/2005 | Armstrong et al. | |
| 7,031,484 | B2 | 4/2006 | Ludvigen | |
| 2003/0012391 | A1 | 1/2003 | Armstrong et al. | |
| 2003/0165246 | A1 | 9/2003 | Kvaloy et al. | |
| 2004/0202333 | A1 | 10/2004 | Csermak et al. | |
| 2005/0105750 | A1 | 5/2005 | Frohlich et al. | |

FOREIGN PATENT DOCUMENTS

| | | | |
|---|---|---|---|
| DE | 33 25 031 | C2 | 5/1987 |
| DE | 103 32 119 | B3 | 12/2004 |
| EP | 1 251 714 | A2 | 10/2002 |
| EP | 1 640 972 | A1 | 3/2006 |
| JP | 54106106 | | 8/1979 |
| JP | 2003284194 | A | 10/2003 |
| JP | 2003304599 | A | 10/2003 |

* cited by examiner

*Primary Examiner*—Brian Ensey
(74) *Attorney, Agent, or Firm*—Schiff Hardin LLP

(57) ABSTRACT

A hearing aid wearer's own voice frequently leads to artifacts and response errors in various hearing aid algorithms. It is provided that the user's own voice to be detected by a special analysis device, and the hearing aid algorithms can be controlled as a function of detection. This can be achieved by providing a microphone in the auditory channel whose signal level is compared with that of an external microphone. This allows some form of control, e.g., the automatic gain control of a hearing aid to be "frozen", in the presence of the hearing aid wearer's own voice.

8 Claims, 1 Drawing Sheet

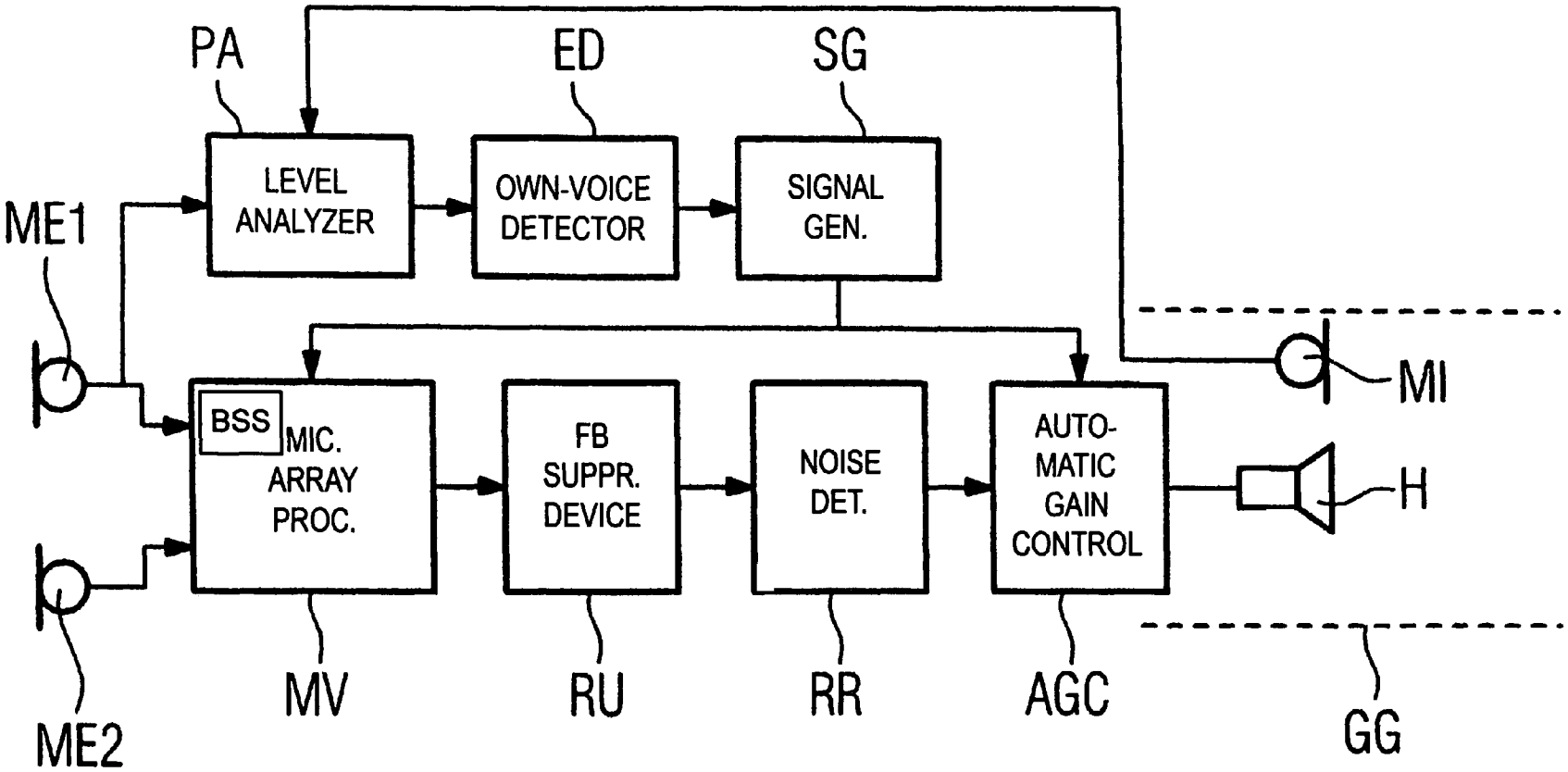
PA
LEVEL ANALYZER
ED
OWN-VOICE DETECTOR
SG
SIGNAL GEN.
ME1
BSS
MIC. ARRAY PROC.
MV
FB SUPPR. DEVICE
RU
NOISE DET.
RR
AUTO-MATIC GAIN CONTROL
AGC
MI
H
GG
ME2

HEARING APPARATUS AND A METHOD FOR OWN-VOICE DETECTION

BACKGROUND

The present invention relates to a hearing apparatus, particularly a hearing aid, having a microphone for picking up ambient sound from the vicinity of a user. The present invention also relates to a corresponding method for operation of a hearing aid.

In conventional hearing aids, it is impossible to distinguish between the hearing aid wearer's own voice and an external sound source. This can lead to artifacts and incorrect response in various hearing aid algorithms, for example:

a) In the case of the automatic gain control (AGC), the gain is automatically reduced for high sound levels. If the sound level were to change suddenly, repeatedly and successively, then the gain would also be varied to a correspondingly major extent. This means that, for example, ambient noise or microphone noise is amplified differently depending on the useful sound level, and this is perceived as a pumping effect by the hearing aid wearer. In order to avoid these pumping effects, the AGC transient times, i.e., the time or time constant for readjustment of the gain, is typically chosen to be relatively long. However, this means that the user's relatively loud own voice (measured at the hearing aid) during a conversation with a relatively quiet conversation partner results in the AGC producing excessively low gain levels in transitional phases. Specifically, if the conversation partner speaks immediately after the hearing aid wearer has stopped speaking, the AGC is in the transient phase, and the gain is correspondingly low. This means that the gain is not increased sufficiently quickly for the generally quieter speech signals of the conversation partner, so that the first syllables or words may possibly not be understood, owing to lack of gain.

b) The approach of an "intelligent directional microphone", which is activated only when a speech source is detected from the 0° forward direction, fails since the user's own voice is detected as a 0° source, and the directional microphone is disadvantageously also activated for a conversation partner at the side.

c) Blind source separation (BSS) algorithms attempt to use statistical methods to separate the superimpositions of the useful sound and the various interference signals that are present in the microphone signals. In this case as well, the user's own voice is identified as a separate source, which interferes with the extraction of the actual useful signal, which is generally likewise a speech signal.

The European patent document number EP 1 251 714 A1 discloses a digital hearing aid system in which an occlusion subsystem compensates for the gain of the hearing aid user's own speech in the auditory channel. In this case, an undesirable signal which is received from a rearward microphone is fed back, and is subtracted from the useful signal.

U.S. Pat. No. 6,041,129 also discloses a hearing aid in which the hearing aid user's own voice is amplified or attenuated. In this case, the sound which is transmitted by bone conduction is detected via an accelerometer or a motion sensor.

The German patent document number DE 33 25 031 C2 describes an infrared headset with two microphones. Their signals are supplied in antiphase to an amplifier, thus preventing or suppressing the transmission of the user's own voice.

Furthermore, the German patent specification number DE 103 32 119 B3 discloses a hearing aid which can be worn in the ear and has a second microphone and a second earpiece, which are arranged in a ventilation channel. The signal for the second earpiece is phase-shifted in order to avoid sound being supplied directly to the hearing.

SUMMARY

The object of the present invention is thus to enhance an automatic control of hearing apparatuses in the presence of the user's own voice.

According to various embodiments of the invention, this object is achieved by a hearing apparatus, particularly a hearing aid, having a first microphone for picking up ambient sound from the vicinity of the user, a second microphone for picking up auditory channel sound in the auditory channel or on the auditory channel wall of the user, and an own-voice detection device for detection of the user's own voice from the two microphone signals, and for outputting a corresponding control signal. In addition to a "normal" sound microphone in the auditory channel, a vibration microphone can also be used, (for example, bonded in from the inside), which is connected to the hearing aid housing, and preferably picks up the user's own voice via body sound conduction.

Furthermore, the embodiments of the invention provide a method for operation of a hearing apparatus by picking up a first sound signal from the vicinity of the user, picking up a second sound signal from the auditory channel of the user, detection of the user's own voice by analysis of the two sound signals, and control of the hearing apparatus as a function of the presence of the user's own voice.

Advantageously the activity of the user's own voice is detected permanently and very quickly by the detection approach described above, and this information can then be used directly in the control of algorithms for the hearing apparatus.

This avoids the artifacts and incorrect control actions initiated by the user's own voice.

The user's own-voice detection device preferably has a level analysis unit via which the respective levels of the two microphone signals can be compared, and the presence of the user's own voice in the microphone signals can be detected on the basis of the level comparison. In this case, the occlusion effect of the sound in the auditory channel can advantageously be made use of, on the basis of which the user's own voice produces a considerably higher sound level in the auditory channel, by body sound transmission, than in front of the ear.

It is advantageous to consider only frequencies below 1 kHz for the level analysis. This is because the occlusion effect is most pronounced at the low frequencies.

The hearing apparatus according to an embodiment of the invention may have a BSS device via which separate sources can be identified from the microphone signal or signals, and may have a signal processing device, which can be controlled by the BSS device, in which the drive of the signal processing device by the BSS device remains unchanged at times, when the user's own voice is detected. The means that the extraction of the actual useful signal is not interfered with by the user's own voice.

Furthermore, a hearing apparatus according to an embodiment of the invention may have an AGC device for automatic gain adjustment, which can be temporarily deactivated on detection of the user's own voice, or whose transient time can be temporarily shortened on detection of the user's own voice. In particular, this makes it possible to avoid interference when conversing with a quiet conversation partner.

According to a further embodiment, the hearing apparatus can have a directional microphone which can be deactivated on detection of the user's own voice. This allows an "intelligent directional microphone" to be operated without interference even when the hearing aid wearer is speaking himself.

DESCRIPTION OF THE DRAWING

The present invention is explained below in more detail with reference to the attached drawing, which is a block circuit diagram of a hearing aid according to an embodiment of the invention.

DETAILED DESCRIPTION OF THE PREFERRED EMBODIMENTS

The exemplary embodiment which is described in more detail in the following text represents one preferred embodiment of the present invention.

The problems with the AGC, the BSS, and the intelligent directional microphone which occur when the hearing aid wearer is speaking himself are solved by the detection of the user's own voice with the aid of a separate auditory channel microphone, or microphone Ml within the auditory channel. According to the FIGURE, this is located in the auditory channel GG, in the same way as the earpiece of the hearing aid chosen here. In the present example, two external microphones ME1 and ME2 are located outside the auditory channel GG, in order to pick up the ambient sound from the area surrounding the user or hearing aid wearer.

The detection of the user's own voice is based on the permanent comparison of the signals picked up by the external hearing aid microphones ME1 and ME2 and the internal auditory channel microphone Ml. In the present case, a level analysis PA is carried out on the microphone signals for this purpose. A user's own-voice detection process ED, which follows the level analysis PA, produces a signal which in the simplest case is a binary signal, indicating whether the user's own voice has been detected. Depending on his, a signal generator SG produces a control signal in order to drive a signal processing unit in the hearing aid.

In the present case, the hearing aid has the following signal processing units: a microphone array processing unit MV, for example, whose BSS (and adaptive directional microphone) picks up the microphone signals from the external microphones ME1 and ME2, followed by a feedback suppression device RU, followed by a noise detection unit RR and, finally, an AGC unit for production of an amplified signal for the earpiece H.

Both the microphone processing device MV, including the BSS and the intelligent directional microphone, as well as the amplification unit AGC can be driven and/or influenced by the user's own voice detection PA, ED, SG.

This means that the information about the activity of the user's own voice is used directly for controlling the algorithms mentioned above. By way of example, this allows the BSS adaptation control to be "frozen" when the user's own voice is detected. Furthermore, however, "freezing" of the AGC or temporary shortening of the transient time is also possible when the user's own voice is active. In addition, the directional microphone for detection of the user's own voice can be deactivated in order to provide an "intelligent directional microphone". Otherwise, it would not be possible to distinguish between this and a 0° signal, and the directional microphone would be activated.

In the present example, a level analysis is carried out for detection of the user's own voice. If required, this can be combined with a delay-time analysis or some other analysis.

All of the external signals appear to be quieter in the case of in-the-ear appliances in the auditory channel GG than at the external microphones ME1 and ME2 because of the attenuation effect of the autoplasty and of the hearing aid. The hearing aid gain, which is known for the respective situation, can be taken into account in this level comparison. The level of the user's own voice is considerably higher at the auditory channel microphone than in the case of a measurement using the external hearing aid microphones ME1, ME2 because the bone sound conduction is introduced directly into the closed auditory channel volume (occlusion effect). This level analysis should ideally relate to the frequency below 1 kHz, since the occlusion effect is at its greatest here.

The present invention can also be used for headsets and other mobile hearing apparatuses.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various FIGURES presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A hearing apparatus, comprising:

a first microphone comprising an audio input for picking up ambient sound from a vicinity of a user, and an output for outputting a signal;

a second microphone comprising an audio input for picking up auditory channel sound in an auditory channel or on an auditory channel wall of the user, and an output for outputting a signal;

an own-voice detection device for detection of the user's own voice, comprising a first input that is connected to the output of the first microphone, a second input that is connected to the output of the second microphone, and an output at which a corresponding control signal is provided;

a BSS device, via which separate sources can be identified from the microphone signal or signals, and comprises an output; and a signal processing device, comprising a drive input via which it is controlled by the BSS device, wherein the drive of the signal processing device by the BSS device remains unchanged at times when the user's own voice is detected.

2. The hearing apparatus as claimed in claim 1, wherein the own-voice detection device comprises:

a level analysis device via which respective levels of the first and second microphone signals are compared and a presence of the user's own voice in the microphone signals is detected based on the level comparison.

3. The hearing apparatus as claimed in claim 2, wherein only frequencies below 1 kHz are taken into account by the level analysis unit.

4. The hearing apparatus as claimed in claim 1, further comprising:

an AGC device that is temporarily deactivated on detection of the user's own voice, or that shortens a transient time for the AGC temporarily on detection of the user's own voice.

5. The hearing apparatus as claimed in claim 1, further comprising:

a directional microphone comprising an input for deactivation upon detection of the user's own voice.

6. A method for operating a hearing apparatus, comprising:

picking up a first sound signal from a vicinity of a user;

picking up a second sound signal from an auditory channel of the user;

detecting the user's own voice by analyzing the two sound signals; and controlling the hearing apparatus as a function of a presence of the user's own voice wherein an adaptation of a device in the hearing apparatus remains unchanged in the presence of the user's own voice in the sound signals.

7. The method as claimed in claim 6, wherein the analysis of the two sound signals comprises:

performing a level comparison between the first sound signal and the second sound signal.

8. The method as claimed in claim 7, wherein only frequencies below 1 kHz are taken into account in the analysis.

* * * * *